US007470870B2

(12) United States Patent
Schmidt et al.

(10) Patent No.: US 7,470,870 B2
(45) Date of Patent: Dec. 30, 2008

(54) LOW-VOLTAGE CIRCUIT BREAKER

(75) Inventors: Detlev Schmidt, Berlin (DE); Günter Seidler, Berlin (DE); Ingo Thiede, Berlin (DE); Sezai Türkmen, Berlin (DE); Artur Wajnberg, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 373 days.

(21) Appl. No.: 10/538,640

(22) PCT Filed: Nov. 25, 2003

(86) PCT No.: PCT/DE03/03926

§ 371 (c)(1),
(2), (4) Date: Jun. 10, 2005

(87) PCT Pub. No.: WO2004/055851

PCT Pub. Date: Jul. 1, 2004

(65) Prior Publication Data

US 2006/0145795 A1 Jul. 6, 2006

(30) Foreign Application Priority Data

Dec. 13, 2002 (DE) ..... 102 60 371

(51) Int. Cl.
*H01H 5/00* (2006.01)

(52) U.S. Cl. ..... 200/400

(58) Field of Classification Search ..... 439/171–174, 439/221, 217, 188; 200/50.27, 280, 400; 335/172

See application file for complete search history.

(56) References Cited

U.S. PATENT DOCUMENTS

| | | | | |
|---|---|---|---|---|
| 2,205,186 | A * | 6/1940 | Andre | 439/221 |
| 2,836,684 | A | 5/1958 | Lingal et al. | |
| 3,328,647 | A | 6/1967 | Gryctko | |
| 3,343,042 | A | 9/1967 | Ricci et al. | |
| 3,366,844 | A | 1/1968 | Chamberlin | |
| 3,474,206 | A * | 10/1969 | Gryctko | 200/293 |
| 3,590,199 | A | 6/1971 | Maier | |
| 3,729,606 | A | 4/1973 | Bogert | |
| 4,229,061 | A * | 10/1980 | Majors | 439/217 |
| 4,686,334 | A | 8/1987 | Nebon et al. | |
| 5,837,950 | A * | 11/1998 | Horikawa | 200/50.27 |

FOREIGN PATENT DOCUMENTS

| | | |
|---|---|---|
| DE | 1 088 579 | 9/1960 |
| DE | 36 21 748 A1 | 1/1988 |

* cited by examiner

*Primary Examiner*—Edwin A Leon
(74) *Attorney, Agent, or Firm*—Harness, Dickey & Pierce PLC

(57) ABSTRACT

A low-voltage circuit breaker includes a first contact arrangement, for connecting a fixed contact to a first busbar and a second contact arrangement, for connecting a counter contact, arranged on a contact lever, to a second busbar. A low-voltage circuit breaker is produced, which may be converted with minimal material complexity and little effort from a fixed switch into a modular switch, whereby the busbars of a low-voltage circuit breaker include moulded features such that the low-voltage circuit breaker may be embodied as both a fixed breaker and a modular breaker.

13 Claims, 4 Drawing Sheets

LOW-VOLTAGE CIRCUIT BREAKER

This application is the national phase under 35 U.S.C. §371 of PCT International Application No. PCT/DE2003/003926which has an International filing date of Nov. 25, 2003, which designated the United States of America and which claims priority on German Patent Application number DE 102 60 371.5 filed Dec. 13, 2002, the entire contents of which are hereby incorporated herein by reference.

FIELD

The invention generally relates to a low-voltage power circuit breaker. For example, it may relate to one having a first contact arrangement for the purpose of connecting a stationary contact to a first busbar and having a second contact arrangement for the purpose of connecting an opposing contact, which is arranged on a contact lever, to a second busbar.

BACKGROUND

Low-voltage power circuit breakers have contact arrangements in order to make it possible to rapidly connect or isolate the circuit breaker to or from current-carrying rails. This is desirable, inter alia, for the purpose of removing or carrying out maintenance on the low-voltage power circuit breakers. Low-voltage power circuit breakers are provided with different sizes for different rated currents. The aim here is to keep the physical dimensions of a low-voltage power circuit breaker as low as possible.

Low-voltage power circuit breakers of the type mentioned may be in the form of permanently installed circuit breakers on the one hand or withdrawable circuit breakers on the other hand. In the case of withdrawable circuit breakers, the power circuit breaker is moved and locked in a withdrawable part rack which is provided for this purpose. This makes it possible to connect or isolate the power circuit breaker to or from the busbars more quickly and more easily than in the case of permanently installed circuit breakers. It is therefore desirable to be able to convert permanently installed circuit breakers to withdrawable circuit breakers with as little complexity in terms of materials and work as possible.

SUMMARY

It is an object of an embodiment of the present invention to specify a low-voltage power circuit breaker which can be converted from a permanently installed circuit breaker to a withdrawable circuit breaker with a reduced or even minimum amount of complexity in terms of materials and work.

One particular advantage of an embodiment of the present invention is the fact that the already provided busbars of a permanently installed circuit breaker can be reused in a very simple manner in the conversion to a withdrawable circuit breaker. For this purpose, the busbars of a low-voltage power circuit breaker have design features such that the low-voltage power circuit breaker can be in the form of both a permanently installed circuit breaker and a withdrawable circuit breaker.

In an example embodiment, the busbars have at least one contact region by which the busbars can be arranged permanently on a withdrawable part rack of a low-voltage power circuit breaker. Furthermore, the busbars have at least one accommodating region for a retaining device(s), by which the busbars can be arranged permanently on a withdrawable part rack of a low-voltage power circuit breaker.

In an example embodiment, the accommodating region for retaining device(s) and the contact region are designed such that the busbars can be arranged permanently, but reversibly, on a withdrawable part rack of a low-voltage power circuit breaker.

The abovementioned embodiment of the busbars may make it possible, for example, for them to be arranged directly on the permanently installed circuit breaker for use in a permanently installed circuit breaker. Further, it is also possible for these busbars to be arranged permanently on the withdrawable part rack of a withdrawable circuit breaker when the permanently installed circuit breaker is converted to a withdrawable circuit breaker once said busbars have been removed from the permanently installed circuit breaker, with the result that the conversion of a permanently installed circuit breaker to a withdrawable circuit breaker entails a minimum amount of complexity in terms of materials since only one additional withdrawable part rack is required for this conversion.

Owing to the contact region provided, the busbars can be arranged directly on the withdrawable part rack. In this case, the surfaces of the contact region should end evenly with the surface of the withdrawable part rack with which contact is to be made. As a result of the fact that the busbars have an accommodating region for retaining device(s), it is possible for them to be permanently provided with a retaining means and, as a result, to be permanently locked on the withdrawable part rack of a power circuit breaker.

In a particular example embodiment, both the first and the second busbar have identical dimensions. This advantageously makes it possible for the same contact arrangements, which are preferably in the form of isolating contact arrangements, to be used both for the first busbar and for the second busbar.

In accordance with a further example embodiment, the busbars can be arranged on the withdrawable part rack such that the withdrawable part rack has the same installation depth as the busbars in a permanently installed circuit breaker. This ensures that the busbars need be arranged permanently on the withdrawable circuit breaker merely using retaining device(s) in the regions of said busbars which are provided for this purpose in order to convert the permanently installed circuit breaker to a withdrawable circuit breaker. As a result of the fact that the busbars arranged on a withdrawable part rack have the same installation depth as the busbars in the case of a permanently installed circuit breaker, no further adaptation or conversion work is required.

In an example embodiment, the busbars are in the form of plates or blades.

BRIEF DESCRIPTION OF THE DRAWINGS

The invention will be explained in more detail below with reference to example embodiments which are at least partially illustrated in the figures, in which.

DETAILED DESCRIPTION OF THE EXAMPLE EMBODIMENTS

Figure 1:
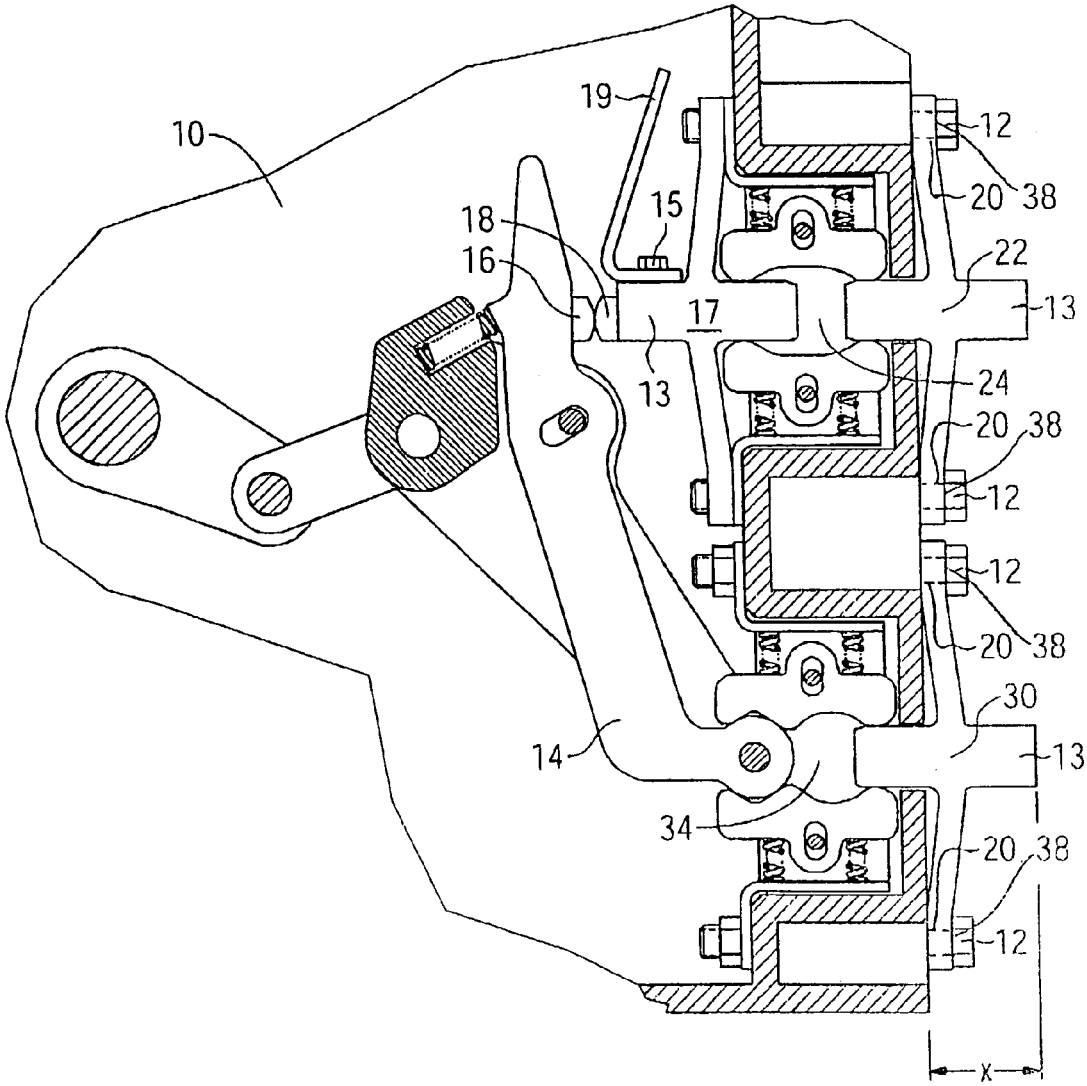
FIG. 1 shows a low-voltage power circuit breaker according to an embodiment of the invention which is in the form of a permanently installed circuit breaker having closed contacts.

As can be seen in FIG. 1, a low-voltage power circuit breaker 10 has a first contact arrangement 24 which produces a connection between a first stationary contact 18, which is arranged on a connection rail 17, and a first busbar 22. Furthermore, the power circuit breaker 10 has a second contact arrangement 34 for the purpose of connecting a second busbar 30 to an opposing contact 16 which is arranged on a contact lever 14. The low-voltage power circuit breaker 10 is in the form of a permanently installed circuit breaker in FIG. 1 by the two busbars 22 and 30, which serve the purpose of producing a connection to system-side busbars which are not further illustrated, being fixed to the outside of the rear wall of the power circuit breaker 10. First retaining means 12, which pass through first accommodating regions 20 of the busbars, are used for this fixing. The connection to the system-side busbars takes place using second retaining device(s) (not illustrated) which pass through second accommodating regions 13 of the busbars 22 and 30.

In order to reduce the variety of circuit breaker parts required and thus to save on production costs, the connection rail 17 and the busbars 22 and 30 are of identical design, the accommodating region 13 of the connection rail 17 serving the purpose of accommodating a fourth retaining means 15. The fourth retaining device(s) 15 serves the purpose of fixing an arcing horn 19 on the connection rail 17.

The first busbar 22 and the second busbar 30, which according to the invention have the accommodating region 20 for retaining device(s) and a contact region 38 for the purpose of arranging the busbars 22, 30 on a withdrawable part rack 11 of the power circuit breaker 10, make contact with the power circuit breaker 10 with their side which faces the power circuit breaker 10. The accommodating region 20 is in the form of a through-hole. The contact region 38 is located on that side of the busbars 22, 30 which is remote from the power circuit breaker 10.

Figure 2:
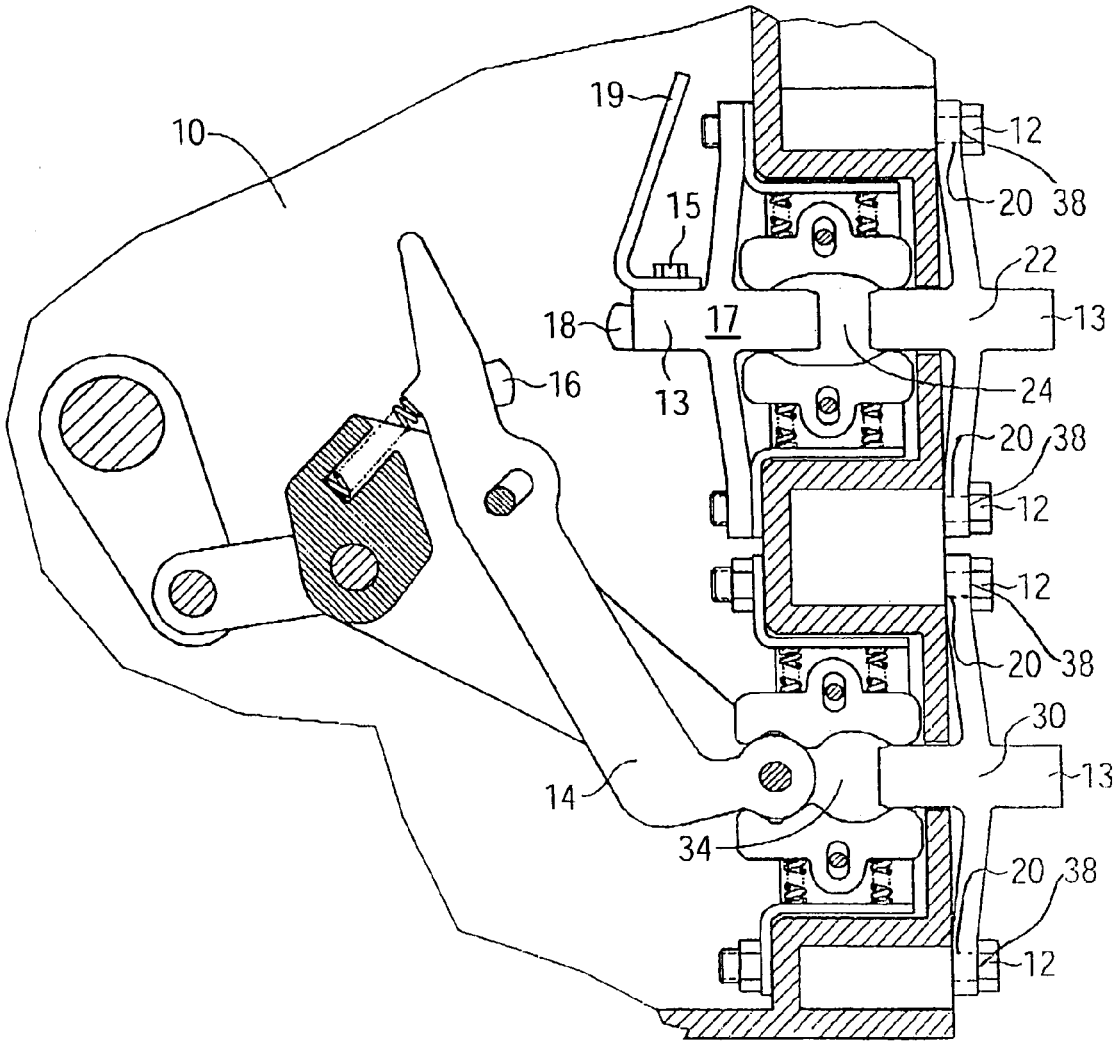
FIG. 2 shows a low-voltage power circuit breaker according to an embodiment of the invention which is in the form of a permanently installed circuit breaker having open contacts.
Figure 3:
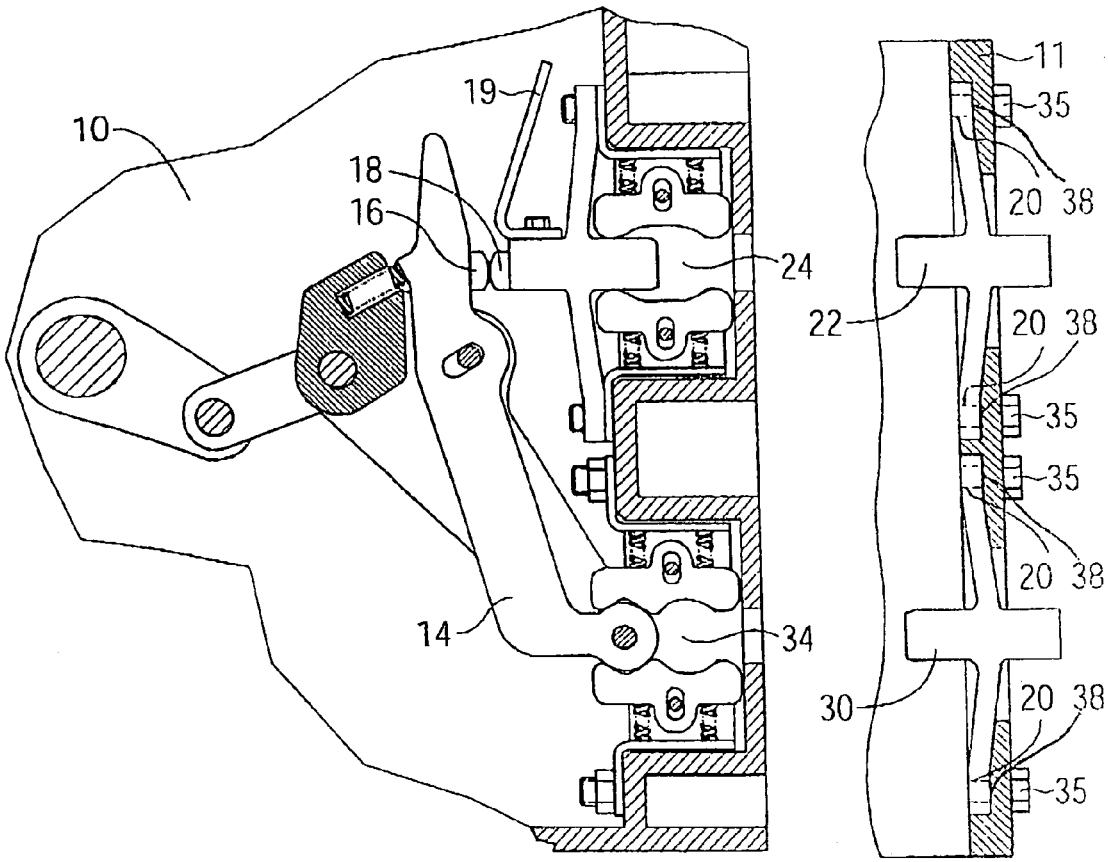
FIG. 3 shows a low-voltage power circuit breaker according to an embodiment of the invention having a corresponding withdrawable part rack.

The contact region 38 makes it possible to remove the busbars 22, 30 according to an example embodiment of the invention of a permanently installed circuit breaker, as illustrated in FIG. 1 and FIG. 2, from the permanently installed circuit breaker and to arrange them on a withdrawable part rack 11 of a power circuit breaker 10, as is illustrated in FIG. 3. Furthermore, the busbars 22, 30 which are arranged in this manner on the withdrawable part rack 11 can be permanently locked by means of third retaining device(s) 35. The retaining device(s) bring about a permanent, force-fitting connection between the busbars 22, 30 and the withdrawable part rack 11 (as is illustrated in FIG. 4) by way of the accommodating regions 20 for retaining device(s).

As has been described above, conversion of the power circuit breaker according to an embodiment of the invention from a permanently installed power circuit breaker to a withdrawable power circuit breaker can be realized in a particularly advantageous manner. The busbars 22, 30, which are locked and arranged on the withdrawable part rack, of the power circuit breaker which is in the form of a withdrawable power circuit breaker advantageously have the same installation depth X as the busbars of a power circuit breaker which is in the form of a permanently installed circuit breaker, in its operating position.

For this purpose, the busbars 22 and 30 are arranged on the inside of the withdrawable part rack which is associated with the withdrawable power circuit breaker such that they make contact with the power circuit breaker with their side which faces the power circuit breaker when the withdrawable power circuit breaker is pushed in, as is also the case with the power circuit breaker in FIGS. 1 and 2 which is designed for permanent installation.

Figure 4:
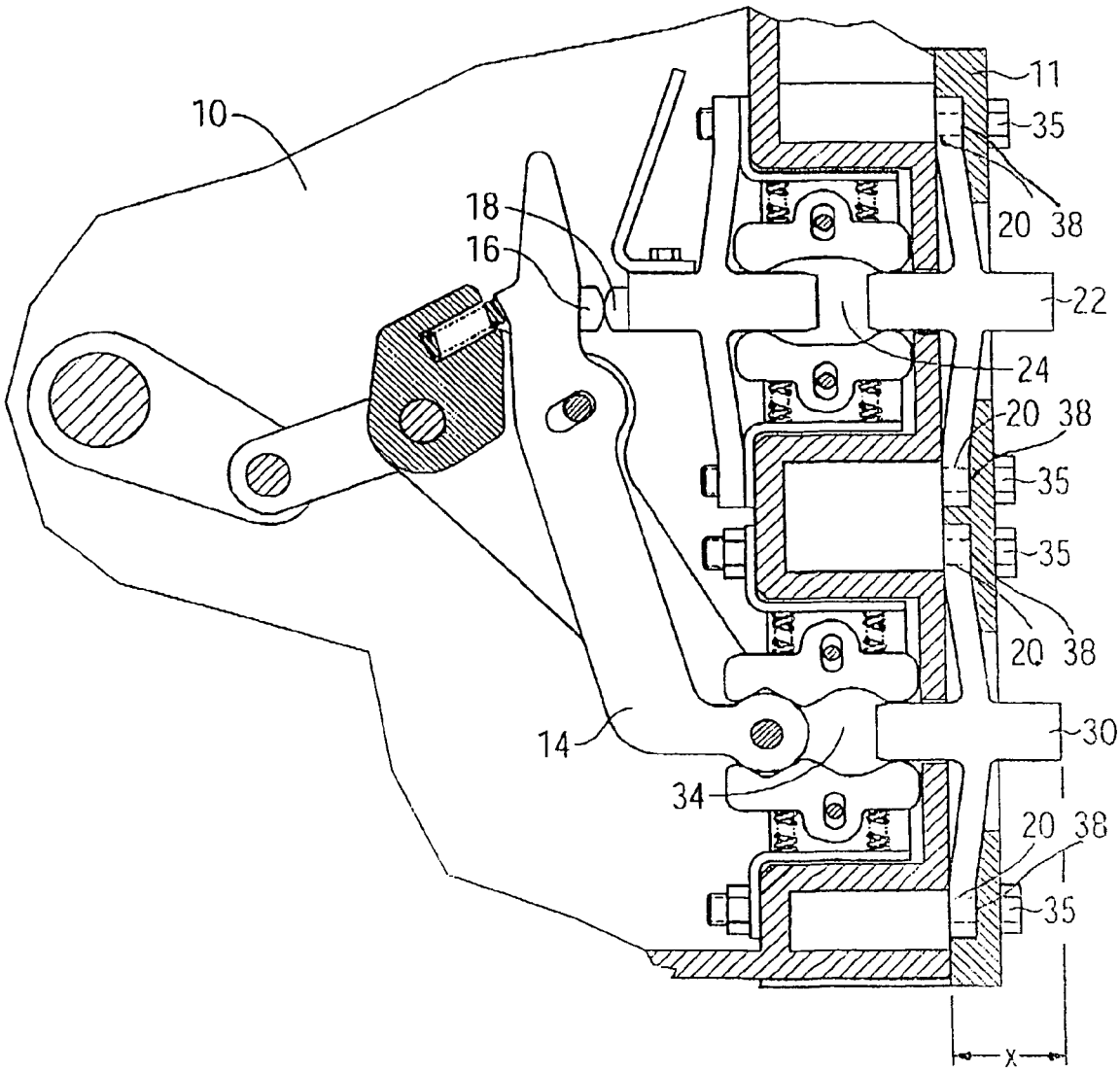
FIG. 4 shows a low-voltage power circuit breaker according to an embodiment of the invention which is in the form of a withdrawable circuit breaker.

The position of the busbars 22 and 30 with respect to the contact arrangements 24 and 34 and with respect to the system-side busbars (not illustrated) is therefore the same in the case of the power circuit breaker in FIGS. 1 and 2, which is in the form of a permanently installed power circuit breaker, as in the case of the power circuit breaker in FIGS. 3 and 4, which is in the form of a withdrawable power circuit breaker.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A system comprising:

a first busbar;

a second busbar; and a low-voltage power circuit breaker including a first contact arrangement for connecting a stationary contact to the first busbar, and a second contact arrangement for connecting an opposing contact, arranged on a contact lever, to the second busbar, each of the first and second busbars including at least one contact region by which the busbars are permanently arrangeable on a withdrawable part rack of the low-voltage power circuit breaker, each of the first and second busbars having a side which faces the low-voltage power circuit breaker, by which the busbars are permanently arrangeable on the outside of the low-voltage power circuit breaker, and each of the first and second busbars including at least one accommodating region for at least one retaining device by which the busbars are permanently lockable on the withdrawable part rack of the low-voltage power circuit breaker so as to form the low-voltage power circuit breaker as a withdrawable circuit breaker or on the outside of the low-voltage power circuit breaker so as to form the low-voltage power circuit breaker as a permanently installed circuit breaker, wherein the busbars are arrangeable on the withdrawable part rack when the low-voltage power circuit breaker is a withdrawable circuit breaker such that they have a same installation depth as the busbars when the low-voltage power circuit breaker is a permanently installed circuit breaker.

2. The system as claimed in claim 1, wherein the busbars are in a form of at least one of plates and blades.

3. The system as claimed in claim 1, wherein the accommodating region for the at least one retaining device and the side which faces the low-voltage power circuit breaker are designed such that the busbars are permanently arrangeable and lockable, reversibly, on the outside of the low-voltage power circuit breaker.

4. The system as claimed in claim 3, wherein the first busbar and the second busbar have identical dimensions.

5. The system as claimed in claim 3, wherein the busbars are arrangeable on the withdrawable part rack when the low-voltage power circuit breaker is a withdrawable circuit breaker such that they have the same installation depth as the busbars when the low-voltage power circuit breaker is a permanently installed circuit breaker.

6. The system as claimed in claim 3, wherein the busbars are in a form of at least one of plates and blades.

7. The system as claimed in claim 3, wherein the accommodating region for the at least one retaining device and the contact region is designed such that the busbars are permanently arrangeable and lockable, reversibly, on the withdrawable part rack of the low-voltage power circuit breaker.

8. The system as claimed in claim 7, wherein the first busbar and the second busbar have identical dimensions.

9. The system as claimed in claim 1, wherein the accommodating region for the at least one retaining device and the contact region are designed such that the busbars are permanently arrangeable and lockable, reversibly, on the withdrawable part rack of the low-voltage power circuit breaker.

10. The system as claimed in claim 9, wherein the first busbar and the second busbar have identical dimensions.

11. The system as claimed in claim 9, wherein the busbars are in a form of at least one of plates and blades.

12. The system as claimed in claim 1, wherein the first busbar and the second busbar have identical dimensions.

13. The system as claimed in claim 12, wherein the busbars are in a form of at least one of plates and blades.

* * * * *